US005911902A

United States Patent [19]

Brinkmann et al.

[11] Patent Number: 5,911,902

[45] Date of Patent: Jun. 15, 1999

[54] USE OF MODIFIED FATTY AMINES FOR PREVENTING LOW MOLECULAR WEIGHT BY-PRODUCT DEPOSITS ON TEXTILE MATERIALS

[75] Inventors: Claudius Brinkmann, Lörrach, Germany; Alfred Keller, Riehen, Switzerland

[73] Assignee: Ciba Specialty Chemicals Corporation, Tarrytown, N.Y.

[21] Appl. No.: 09/110,590

[22] Filed: Jul. 6, 1998

[51] Int. Cl.[6] ..... D06M 13/325; D06M 15/61

[52] U.S. Cl. ..... 252/8.81; 252/8.61; 252/8.84; 8/115.51; 8/115.6; 8/115.7; 8/147; 8/930

[58] Field of Search ..... 252/8.61, 8.81, 252/8.84; 8/115.51, 115.6, 115.7, 147, 930

[56] References Cited

U.S. PATENT DOCUMENTS

| | | | |
|---|---|---|---|
| 4,054,716 | 10/1977 | Topfl | 428/413 |
| 4,155,856 | 5/1979 | Reinert et al. | 252/8.9 |

OTHER PUBLICATIONS

Chem. Abstr. 126:158716t, abstract of Japanese Patent Specification No. 08–325,960 (Dec. 10, 1996).

Chemical Abstract No. 86:74911, abstract of German Patent Specification No. 2525995, Dec. 1976.

WPIDS Abstract No. 83–34180K, abstract of Soviet Union Patent Specification No. 931867, Jun. 1982.

WPIDS Abstract No. 87–282864, abstract of Soviet Union Patent Specification No. 1294891, Mar. 1987.

*Primary Examiner*—Anthony Green

*Attorney, Agent, or Firm*—Kevin T. Mansfield; David R. Crichton

[57] ABSTRACT

The present invention relates to the use of a modified fatty amine of formula $$R—NR_3—(R_1—O)_n—R_2 \quad (1),$$

wherein

R is $C_9$–$C_{24}$alkyl or acyl, $R_1$ is $C_2$–$C_4$alkylene, $R_2$ is hydrogen, $C_1$–$C_4$alkyl or acyl, $R_3$ is hydrogen or $(R_1—O)_m$, n and m are each independently of the other an integer from 2 to 100, and $(R_1—O)_n$ is n identical or different radicals $(R_1—O)$, and $(R_1—O)_m$ is m identical or different radicals $(R_1—O)$, for reducing or preventing low molecular weight by-product deposits developing in the course of the polyester fiber material production process on textile materials consisting of polyester fibers or containing these fibers in blends with other fibers.

11 Claims, No Drawings

USE OF MODIFIED FATTY AMINES FOR PREVENTING LOW MOLECULAR WEIGHT BY-PRODUCT DEPOSITS ON TEXTILE MATERIALS

The present invention relates to the use of modified fatty amines for reducing or preventing low molecular weight by-product deposits developing in the course of a polyester fibre material production process on textile materials consisting of polyester fibres or containing these fibres in blends with other fibres.

The low molecular weight by-products developing in the course of a polyester fibre production process and adhering at or in the fibres bring about irksome faults in the textile finishing processes, e.g. dyeing or finishing, such as unlevelness, changes in shade, reduction of the tinctorial strength, or staining. In addition, these deposits can cause increased thread breakage during the processing of yarn.

There is thus a need to prevent the faults brought about by the low molecular weight by-product deposits.

Surprisingly, it has been found that the deposits of undesirable low molecular weight by-products can be markedly reduced or completely prevented by the inventive use of the modified fatty amines.

Accordingly, this invention relates to the use of a modified fatty amine of formula $$R—NR_3—(R_1—O)_n—R_2 \quad (1),$$

wherein

R is $C_9$–$C_{24}$alkyl or acyl, $R_1$ is $C_2$–$C_4$alkylene, $R_2$ is hydrogen, $C_1$–$C_4$alkyl or acyl, $R_3$ is hydrogen or $(R_1—O)_m$, n and m are each independently of the other an integer from 2 to 100, and $(R_1—O)_n$ is n identical or different radicals $(R_1—O)$, and $(R_1—O)_m$ is m identical or different radicals $(R_1—O)$, for reducing or preventing low molecular weight by-product deposits developing in the course of the polyester fibre material production process on textile materials consisting of polyester fibres or containing these fibres in blends with other fibres.

In formula (1):

R is preferably $C_{14}$–$C_{20}$alkyl;

$R_1$ is preferably propylene and, more preferably, ethylene;

$R_2$ is preferably $C_1$–$C_4$alkyl and, more preferably, hydrogen;

n is a number from 2 to 25, preferably from 4 to 25, more preferably from 4 to 12; n is very particularly preferably a number from 4 to 8;

m is a number from 2 to 25, preferably from 4 to 25, more preferably from 4 to 12; m is very particularly preferably a number from 4 to 8;

the sum of m+n is preferably in the range from 4 to 50, more preferably from 4 to 16, most preferably from 4 to 8.

The amines of formula (1) are known or can be prepared by known methods.

The modified fatty amine of formula (1) can be applied to the polyester-containing textile material in those apparatus customarily used in the textile finishing industry and by a method customarily used in the textile finishing industry, for example from a pretreatment liquor, or before or, preferably, after a dyeing process from the dyeing liquor. The modified fatty amine of formula (1) is advantageously used in the beam and jet dyeing processes.

The modified fatty amine of formula (1) can be applied to the polyester-containing textile material e.g. as a solution, preferably as a 10 to 50%, optionally solvent-containing, aqueous solution, or as a 10 to 50% anhydrous solution, or in the form of a dispersion. The customary dispersants used for dispersing fatty amines, preferably nonionic dispersants, are suitable for the preparation of such dispersions. Suitable nonionic dispersants are in particular compounds selected from the group of the (ca) alkylene oxide adducts of formula (2)

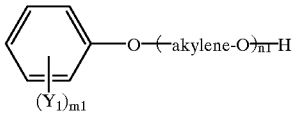

wherein $Y_1$ is $C_1$–$C_{12}$alkyl, aryl or aralkyl, "alkylene" denotes the ethylene or propylene radical, and $m_1$ is 1 to 4, and $n_1$ is 4 to 50, (cb) alkylene oxide adducts with saturated or unsaturated 1–6-valent aliphatic alcohols, fatty acids, fatty amines, fatty amides, diamines or sorbitan esters, (cc) alkylene oxide condensates (block polymers)

(cd) polymers of vinylpyrrolidone, vinyl acetate or vinyl alcohol, and (ce) co- or terpolymers of vinylpyrrolidone with vinyl acetate and/or vinyl alcohol.

Suitable solvents for the preparation of an anhydrous or, where appropriate, solvent-containing, solution of the modified fatty amine of formula (1) to be mentioned are, for example, ethylene glycol, diethylene glycol, mono-, di- and tri-butyl glycol, diethylene glycol methyl ether, diethylene glycol ethyl ether, diethylene glycol propyl ether, 1,2-dimethyl-2,4-pentadiol, polyethylenepropylene glycol ether, dipropylene glycol methyl ether, dipropylene glycol butyl ether, hexylene glycol, polyethylene glycols containing 6 to 25 ethylene oxide units, isopropanol and n-butanol.

The modified fatty amine of formula (1) is used in the pretreatment liquor or in the dye bath in an amount of 0.03 to 5 g/l, preferably of 0.15 to 2 g/l.

The modified fatty amine of formula (1) is preferably applied in the form of a suitable formulation.

In another of its aspects, this invention relates to a formulation, which comprises as component (A)

3 to 50% by weight of a compound of formula $$R—NR_3—(R_1—O)_n—R_2 \quad (1),$$

wherein

R is $C_9$–$C_{24}$alkyl or acyl, $R_1$ is $C_2$–$C_4$alkylene, $R_2$ is hydrogen, $C_1$—$C_4$alkyl or acyl, $R_3$ is hydrogen or $(R_1—O)_m$, n and m are each independently of the other an integer from 2 to 100, and $(R_1—O)_n$ is n identical or different radicals $(R_1—O)$, and $(R_1—O)_m$ is m identical or different radicals $(R_1—O)$, and R, $R_1$, $R_2$ $R_3$,n and m have the meanings given above, and as component (B)

2 to 10% by weight of dodecylbenzenesulfonic acid, as well as optional further components.

A preferred formulation is that which comprises as component (A) 3 to 30% by weight of a compound of formula (1) and as component (B) 2 to 10% by weight of dodecylbenzenesulfonic acid, as well as optional further components.

Component (A) has the preferred meanings cited above.

The dodecylbenzenesulfonic acid used as component (B) is used as such or, preferably, in the form of salts, for example the ammonium or monoethanol ammonium salt.

It is preferred to use an aqueous formulation which comprises as component (A) 3 to 50% by weight, preferably 3 to 30% by weight, of a compound of formula (1), and as component (B) 2 to 10% by weight of dodecylbenzenesulfonic acid, as well as optional further components.

The novel formulation advantageously comprises as component (C) 5 to 50% by weight, preferably 10 to 50% by weight, more preferably 20 to 40% by weight, of a compound from the group of the monovalent and polyvalent alcohols, ethylene glycols, polyethylene glycols, propylene glycols and polypropylene glycols, addition products of 4 to 100 mol of ethylene oxide and/or propylene oxide with monovalent and polyvalent alcohols, ethylene glycols, polyethylene glycols, propylene glycols and polypropylene glycols, which addition products are optionally sulfated or phosphated and are preferably used in the form of soluble salts.

Illustrative examples of such compounds are, inter alia, ethylene glycol, diethylene glycol, mono-, di- and tri-butyl glycol, diethylene glycol methyl ether, diethylene glycol ethyl ether, diethylene glycol propyl ether, 1,2-dimethyl-2, 4-pentadiol, polyethylenepropylene glycol ether, dipropylene glycol methyl ether, dipropylene glycol butyl ether, hexylene glycol, polyethylene glycols having 6 to 25 ethylene oxide units, isopropanol and n-butanol.

Preferred components (C) are sulfated or phosphated addition products of 4 to 100 mol of ethylene oxide and/or propylene oxide with polyvalent alcohols.

The novel formulation can furthermore comprise dispersants, for example the dispersants described above, solubilisers, typically alkylsulfonates, such as 2-ethylhexylsulfonate, alkylarylsulfonates, such as cumene sulfonate, ethoxylated vegetable oils, such as soybean oil ethoxylates, castor oil ethoxylates or coconut oil ethoxylates having 20 to 50 ethylene oxide units, or mono- or dialkylated diphenyl oxide mono- or disulfonic acid, preservatives, such as formaldehyde-donating agents, for example paraformaldehyde and trioxane, in particular aqueous, about 30 to 40% by weight formaldehyde solutions, carriers, typically alkylbenzene, biphenyl compounds, alkylbenzoates, halogenated aromatic compounds, such as trichlorobenzene or alkylphthalates, wetting agents, levelling agents, antifoams, lubricants, such as polyether polymers, phosphates or polyglycol fatty acid esters or UV stabilisers, typically benzophenone, benzotriazole or s-triazine UV absorbers, as well as other auxiliaries customarily used in the textile finishing industry.

The preparation of the novel formulations is usually carried out by simple blending of the individual components, preferably at elevated temperature, for example in the range from 30 to 60° C.

In another of its aspects, this invention relates to a process for reducing or preventing low molecular weight by-product deposits on polyester-containing textile fibre materials, which process comprises using the formulation of this invention.

The novel formulations can be applied to the polyester or polyester-containing textile fibre materials before, during or after a finishing process, e.g. conveniently before, during or after a dyeing process. Applications during and, in particular before, the actual dyeing process are preferred.

The novel formulation can be used in the apparatus customarily employed in the textile finishing industry, advantageously in the beam and jet dyeing processes.

The novel formulations are applied to the fibre material by the usual methods used in the textile finishing industry. Application by the exhaust process is preferred. Application of the novel formulations by the exhaust dyeing process is usually carried out in the temperature range from 80 to 145° C. and at a pH from 4 to 12, preferably from 4 to 6. The liquor ratio can be chosen from a wide range, e.g. from 1:5 to 1:40, preferably from 1:8 to 1:25.

The novel formulations are used in the liquor in an amount from 0.1 to 10 g/l, preferably from 0.5 to 5 g/l.

A preferred embodiment of the process of this invention is that, wherein e.g. the polyester-containing fibre material to be dyed is first treated with the novel formulation for e.g. 5 to 10 minutes at 50 to 70° C. and is then dyed in the same bath after addition of the dye at a temperature of up to 140° C. At the end the bath is cooled and the dyed fibre material is finished as usual.

Of the dyes used in a dyeing process those dyes are suitable for the novel process which are described in Colour Index, 3$^{rd}$ Edition (3. Revision 1987 inclusive Additions and Amendments to No. 85) under "Disperse Dyes". These dyes are, for example, nitro, amino, amino-ketone, ketone imine, methine, polymethine, diphenylamine, quinoline, benzimidazole, xanthene, oxazine or coumarine dyes and, in particular, anthraquinone and azo dyes, such as mono- or disazo dyes, all of which dyes are free of carboxylic acid groups and/or sulfonic acid groups.

The invention is illustrated by the following Examples. Temperatures are given in degrees Celsius and parts and percentages are by weight, unless otherwise stated. The ratio of parts by weight to parts by volume is the same as that between the kilogramme and the liter.

Example 1

A reaction flask equipped with a stirrer is charged with 40.0 parts by weight of ethyl oleate. Stirring continuously, there are added in succession 15.0 parts by weight of a tallow fatty amine reacted with 8 mol of ethylene oxide, 6.0 parts by weight of dodecylbenzenesulfonic acid, and 39.0 parts by weight of water and this mixture is stirred until homogeneous. The pH of this mixture is then adjusted with ammonia to a value from 7 to 8.

Example 2

A reaction flask equipped with a stirrer is charged with 36.0 parts by weight of castor oil reacted with 36 mol of ethylene oxide. The contents of the flask are then heated to 50° C. and, stirring continuously, there are added in succession 1.5 parts by weight of the sodium salt of sulfated nonylphenol reacted with 2 mol of ethylene oxide, 10.0 parts by weight of polypropylene glycol 600, 0.5 part by weight of the ethylene diamine tetraacetic acid sodium salt, 5.0 parts by weight of dodecylbenzenesulfonic acid, 7.0 parts by weight of a tallow fatty amine reacted with 8 mol of ethylene oxide, and 40.0 parts by weight of water and this mixture is stirred until homogeneous and is then cooled to room temperature. The pH of this mixture is then adjusted with ammonia to a value from 7 to 8.

Example 3

A reaction flask equipped with a stirrer is charged with 20.0 parts by weight of the sodium salt of an ethoxylated 1,4-butanediol sulfate ester having an average molar mass of 2000. The contents of the flask are then heated to 60° C. and, stirring continuously, there are added in succession 6.0 parts by weight of dodecylbenzenesulfonic acid, 25.0 parts by weight of a tallow fatty amine reacted with 8 mol of ethylene oxide, and 49.0 parts by weight of water and this mixture is stirred until homogeneous and is then cooled to room temperature. The pH of this mixture is then adjusted with ammonia to a value from 7 to 8.

Example 4

A reaction flask equipped with a stirrer is charged with 20.0 parts by weight of polyethylene glycol 400, and 10.0 parts by weight of polypropylene glycol 400. The contents of the flask are then heated to 50° C. and, stirring continuously, there are added in succession 1.0 part by weight of the ethylenediaminetetraacetic acid sodium salt, 2.0 parts by weight of dodecylbenzenesulfonic acid, 30.0 parts by weight of a tallow fatty amine reacted with 8 mol of ethylene oxide, and 37.0 parts by weight of water and this mixture is stirred until homogeneous and is then cooled to room temperature. The pH of this mixture is then adjusted with ammonia to a value from 7 to 8.

Example 5

A reaction flask equipped with a stirrer is charged with 50.0 parts by weight of hexylene glycol 30.0 parts by weight of a tallow fatty amine reacted with 8 mol of ethylene oxide, and 20.0 parts by weight of water. The contents of the flask are then heated to 50° C., stirred until homogeneous and cooled to room temperature.

Example 6

A reaction flask equipped with a stirrer is charged with 80.0 parts by weight of dipropylene glycol and 20.0 parts by weight of a tallow fatty amine reacted with 8 mol of ethylene oxide. The contents of the flask are then heated to 30° C., stirred until homogeneous and cooled to room temperature.

Example 7

A 25 g piece of a polyester fabric is treated for 5 minutes at 60° C. in a laboratory dyeing apparatus at a liquor ratio of 1:14 with a liquor comprising, per 1 liter of the liquor, 2 g of ammonium sulfate, 4 g of a commercially available carrier, and 2 g of the formulation of Example 3, which liquor is adjusted to pH 5.5 with formic acid. Subsequently, 25 ml of a 3% solution of the dye of formula (4)

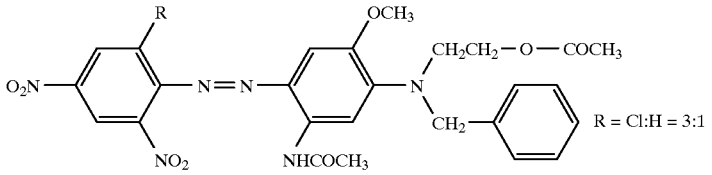

are added to this liquor. After 5 minutes the temperature of the liquor is raised over 40 minutes to 135° C. and the polyester fabric is treated for 60 minutes at this temperature. The liquor is then cooled to 60° C. and the dyed polyester fabric is rinsed with cold water and dried. This gives a level blue highly coloured dyeing without any deposits or with only a trace thereof.

Example 8

A 25 g piece of a polyester fabric is treated for 5 minutes at 60° C. in a laboratory dyeing apparatus at a liquor ratio of 1:14 with a liquor comprising, per 1 liter of the liquor, 2 g of ammonium sulfate and 0.2 g of a 40% aqueous solution of a tallow fatty amine reacted with 8 mol of ethylene oxide, which liquor is adjusted to pH 5.5 with formic acid. Subsequently, 25 ml of a 3% solution of the dye of formula (4) are added to the liquor. After 5 minutes the temperature of the liquor is raised over 40 minutes to 135° C. and the polyester fabric is treated for 60 minutes at this temperature. The liquor is then cooled to 60° C. and the dyed polyester fabric is rinsed with cold water and dried. This gives a level blue highly coloured dyeing without any deposits or with only a trace thereof.

Example 9

The general procedure of Example 7 is repeated, but replacing 0.2 g of a 40% solution of a tallow fatty amine reacted with 8 mol of ethylene oxide with 0.3 g of the formulation specified in Example 5, which likewise gives a level blue highly coloured dyeing without any deposits or with only a trace thereof.

Example 10

The general procedure of Example 7 is repeated, but replacing 0.2 g of a 40% solution of a tallow fatty amine reacted with 8 mol of ethylene oxide with 0.4 g of the formulation specified in Example 6, which likewise gives a level blue highly coloured dyeing without any deposits or with only a trace thereof.

What is claimed is:

1. A process for reducing or preventing by-product deposits developing in the course of a polyester fibre material production process on textile materials consisting of polyester fibres or containing polyester fibres in blends with other fibres, which comprises applying to the fibres a modified fatty amine of the formula $$R—NR_3—(R_1—O)_n—R_2 \quad (1),$$

wherein

R is $C_9$–$C_{24}$alkyl or acyl, $R_1$ is $C_2$–$C_4$alkylene, $R_2$ is hydrogen, $C_1$–$C_4$alkyl or acyl, $R_3$ is hydrogen or $(R_1—O)_m$, n and m are each independently of the other an integer from 2 to 100, and in the $(R_1—O)_n$ and $(R_1—O)_m$ radicals, $R_1$ can be the same or different.

2. A process according to claim 1, wherein R is $C_{14}$–$C_{20}$alkyl.

3. A formulation, which comprises as component (A) 3 to 50% by weight of a compound of formula $$R—NR_3—(R_1—O)_n—R_2 \quad (1),$$

in which

R is $C_9$–$C_{24}$alkyl or acyl, $R_1$ is $C_2$–$C_4$alkylene, $R_2$ is hydrogen, $C_1$–$C_4$alkyl or acyl, $R_3$ is hydrogen or $(R_1—O)_m$, n and m are each independently of the other an integer from 2 to 100, and in the $(R_1—O)_n$ and $(R_1—O)_m$ radicals, $R_1$ can be the same or different, and as component (B) 2 to 10% by weight of dodecylbenzenesulfonic acid, as well as optional further components selected from the group consisting of dispersants, solubilisers, preservatives, carriers, wetting agents, levelling agents, antifoams, lubricants, UV stabilisers, UV absorbers and other auxiliaries used in the textile finishing industry.

4. A formulation according to claim 3, wherein component (A) is 3 to 30% by weight of a compound of formula (1).

5. A formulation according to claim 4, which comprises as additional component (C) 5 to 50% by weight of a compound selected from from the group consisting of monovalent and polyvalent alcohols, ethylene glycols, polyethylene glycols, propylene glycols and polypropylene glycols, and addition products of 4 to 100 mol of ethylene oxide and/or propylene oxide with monovalent and polyvalent alcohols, ethylene glycols, polyethylene glycols, propylene glycols, and polypropylene glycols.

6. A formulation according to claim 3, which further comprises as additional component (C) 5 to 50% by weight of a compound selected from the group consisting of monovalent and polyvalent alcohols, ethylene glycols, polyethylene glycols, propylene glycols and polypropylene glycols, and addition products of 4 to 100 mol of ethylene oxide and/or propylene oxide with monovalent and polyvalent alcohols, ethylene glycols, polyethylene glycols, propylene glycols and polypropylene glycols.

7. A formulation according to claim 6 wherein the addition products are in the form of soluble salts.

8. A formulation according to claim 6 wherein the addition products are sulfated or phosphated.

9. A formulation according to claim 5 wherein the addition products are in the form of soluble salts.

10. A formulation according to claim 5 wherein the addition products are sulfated or phosphated.

11. A process for reducing or preventing by-product deposits on polyester containing fibre material, which comprises applying a liquor containing 0.1 to 10 g/l of a formulation according to claim 3 to the polyester-containing fibre materials before, during or after a dyeing process.

* * * * *

UNITED STATES PATENT AND TRADEMARK OFFICE

CERTIFICATE OF CORRECTION

PATENT NO. : 5,911,902
DATED : June 15, 1999
INVENTOR(S) : Claudius Brinkmann, et. al.

It is certified that error appears in the above-indentified patent and that said Letters Patent is hereby corrected as shown below:

Title page, item [30] should read:

Foreign Application Priority Data

Jul. 10, 1997 Switzerland 1688/97 --.

Signed and Sealed this

Sixteenth Day of November, 1999

*Attest:*

*Attesting Officer*

Q. TODD DICKINSON

*Acting Commissioner of Patents and Trademarks*